US010386139B1

(12) United States Patent
Sharps et al.

(10) Patent No.: US 10,386,139 B1
(45) Date of Patent: Aug. 20, 2019

(54) CUSTOMIZABLE FIREARM LOWER RECEIVER

(71) Applicant: Sharps Bros, LLC, Eugene, OR (US)

(72) Inventors: John Sharps, Eugene, OR (US); Linda Sharps, Eugene, OR (US)

(73) Assignee: SHARPS BROS, LLC, Eugene, OR (US)

( * ) Notice: Subject to any disclaimer, the term of this patent is extended or adjusted under 35 U.S.C. 154(b) by 0 days.

(21) Appl. No.: 16/169,762

(22) Filed: Oct. 24, 2018

(51) Int. Cl.
*F41A 3/66* (2006.01)
*F41A 17/38* (2006.01)
*F41A 11/02* (2006.01)

(52) U.S. Cl.
CPC ..... *F41A 3/66* (2013.01); *F41A 11/02* (2013.01); *F41A 17/38* (2013.01)

(58) Field of Classification Search
CPC ..... F41A 3/66; F41A 11/02; F41A 35/00
USPC ..... 42/75.03, 106, 90, 49.02, 49.01, 50, 72
See application file for complete search history.

(56) References Cited

U.S. PATENT DOCUMENTS 8,127,480 B1 * 3/2012 McManus ..... F41A 9/82 42/49.02
9,207,041 B1 * 12/2015 Bast ..... F41C 23/16

* cited by examiner

*Primary Examiner* — Reginald S Tillman, Jr.
(74) *Attorney, Agent, or Firm* — Lowe Graham Jones PLLC

(57) ABSTRACT

A customizable firearm lower receiver includes a lower receiver body having a forward end and a rearward end, the forward end having a first lateral sidewall and an opposing second lateral sidewall, with a forward end wall between the first lateral sidewall and the second lateral sidewall. The opposing lateral sidewalls at least partially surround a magazine well. A mounting surface is configured on the lower receiver body along one of the forward end wall, first lateral sidewall, and second lateral sidewall. A custom face is removably attachable to the mounting surface.

20 Claims, 6 Drawing Sheets

CUSTOMIZABLE FIREARM LOWER RECEIVER

FIELD OF THE INVENTION

This application relates generally to firearms, particularly including firearm lower receivers.

BACKGROUND OF THE INVENTION

Firearms such as rifles are popular among hunters, gun enthusiasts, sharpshooters, military and police personnel, and the like. Increasingly, firearm enthusiasts have favored a variety of lower receivers having incorporated designs such as the design incorporated into U.S. Pat. D773,586 for a firearm having skull design. While such novel designs are attractive and desirable, each such design is integrally formed in the lower receiver itself, limiting a single lower receiver to a single aesthetic design. A readily tailorable lower receiver is not presently available.

SUMMARY OF THE INVENTION

In a preferred example of the invention, a firearm lower receiver includes a removable custom face configured as an insert having a particular design, color, logo, or the like. In one version of the invention, the insert is in the form of a plate configured to be retained against a forward lateral face at a forward end of the lower receiver. In other versions the custom face may not be planar, but rather may have a raised or lowered surface.

One version of the customizable firearm lower receiver includes a lower receiver body having a forward end and a rearward end, the forward end having a first lateral sidewall and an opposing second lateral sidewall, with a forward end wall between the first lateral sidewall and the second lateral sidewall. The opposing lateral sidewalls at least partially surround a magazine well. A mounting surface is configured on the lower receiver body along one of the forward end wall, first lateral sidewall, and second lateral sidewall. A custom face is removably attachable to the mounting surface.

In one version, the first lateral sidewall comprises a cavity configured to receive the custom face, wherein the custom face is mounted within the cavity when the custom face is attached to the lower receiver body.

In one example, the lower receiver body is configured to receive a fastener, the fastener engaging the custom face to retain the custom face against the lower receiver body when the custom face is attached to the lower receiver body.

In some cases, the lower receiver body further comprises an upper channel formed along an upper end of the lower receiver body, the custom face having an upper edge configured to be received within the upper channel.

In one example, the custom face is formed as a plate.

In a preferred version, the lower receiver body further comprises an upper bar, the upper channel being formed within the upper bar, and further wherein the lower receiver body comprises a rearward bar, the upper channel continuing to form a rearward channel formed in the rearward bar, the custom face having a rearward edge configured to be received within the rearward channel.

A threaded bore may be positioned in the upper bar and a fastener receivable within the threaded bore, the fastener engaging the custom face to retain the custom face within the upper channel when the custom face is attached to the lower receiver body.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 6:
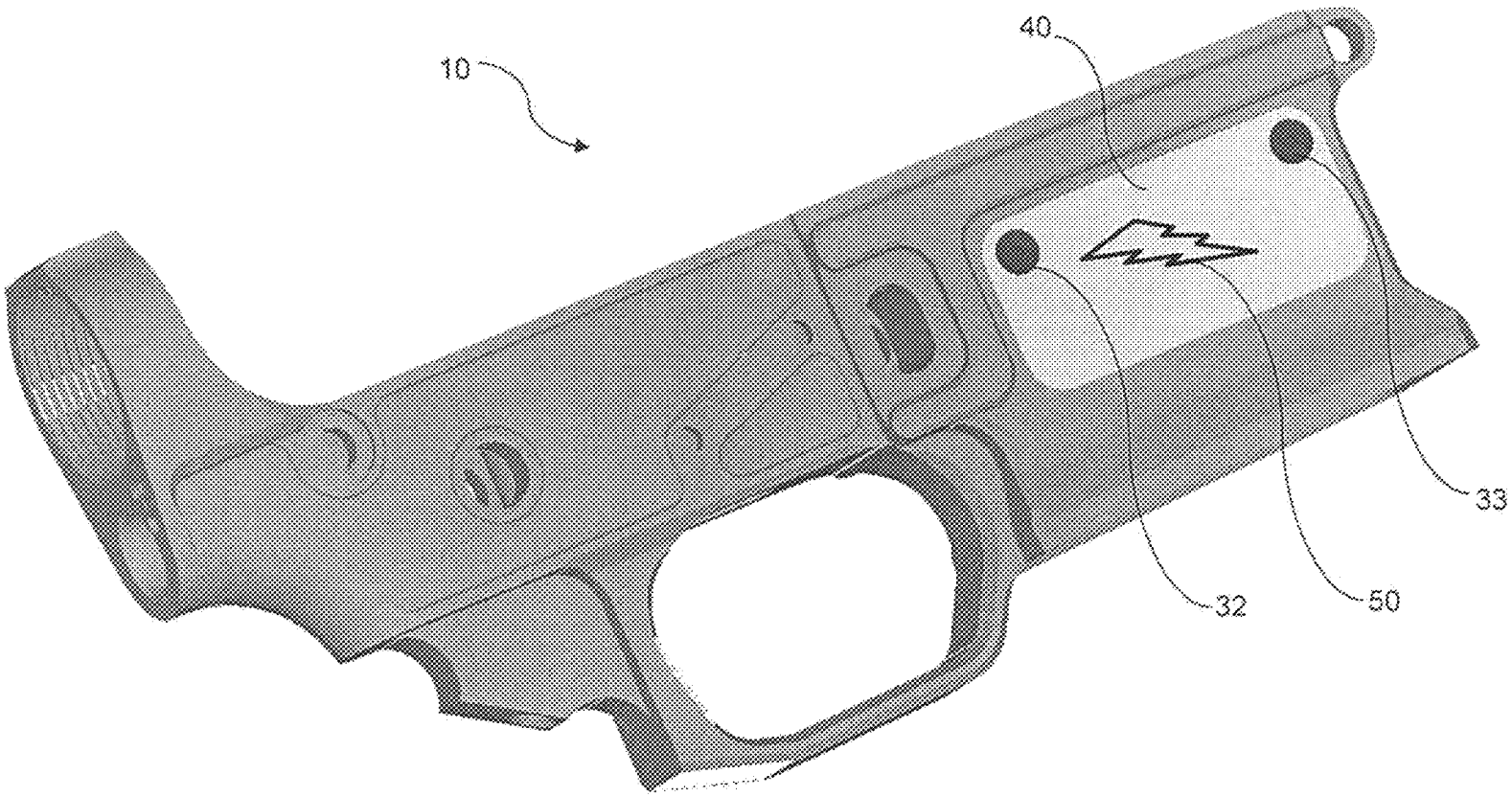
FIG. 6 is a perspective view of an alternate version of a firearm lower receiver having a removable insert.

A firearm lower receiver is illustrated in each of the accompanying figures, showing a preferred embodiment in FIGS. 1-5 and an alternate embodiment in FIG. 6. In the illustrated example, the lower receiver is designed for use with an AR-15 rifle. It should be appreciated that the present invention may be employed in other lower receiver configurations for other rifles and that the use of an AR-15 lower receiver is merely a preferred example of the invention.

With reference to the accompanying figures, the preferred customizable lower receiver includes a lower receiver body 10 includes a forward end 16 and a rearward end 17. The forward end may include, as illustrated, a pair of lobes 14, 15 having through-holes for pivotal attachment of an upper receiver, which is not shown. The rearward end may include attachment locations for a grip and other components, and preferably also includes a stock interface 13 configured as a raised lobe having internal threads. A magazine well 11 is positioned at the forward end 16 and is defined partially by opposing lateral sidewalls 18, 21 extending between an upper end 22 and lower end 23 of the lower receiver, and by a forward end wall positioned between the lateral sidewalls 18, 21 at the forward end 16. A trigger guard 12 extends along a lower portion of the lower receiver between the magazine well and the rearward end.

Figure 1:
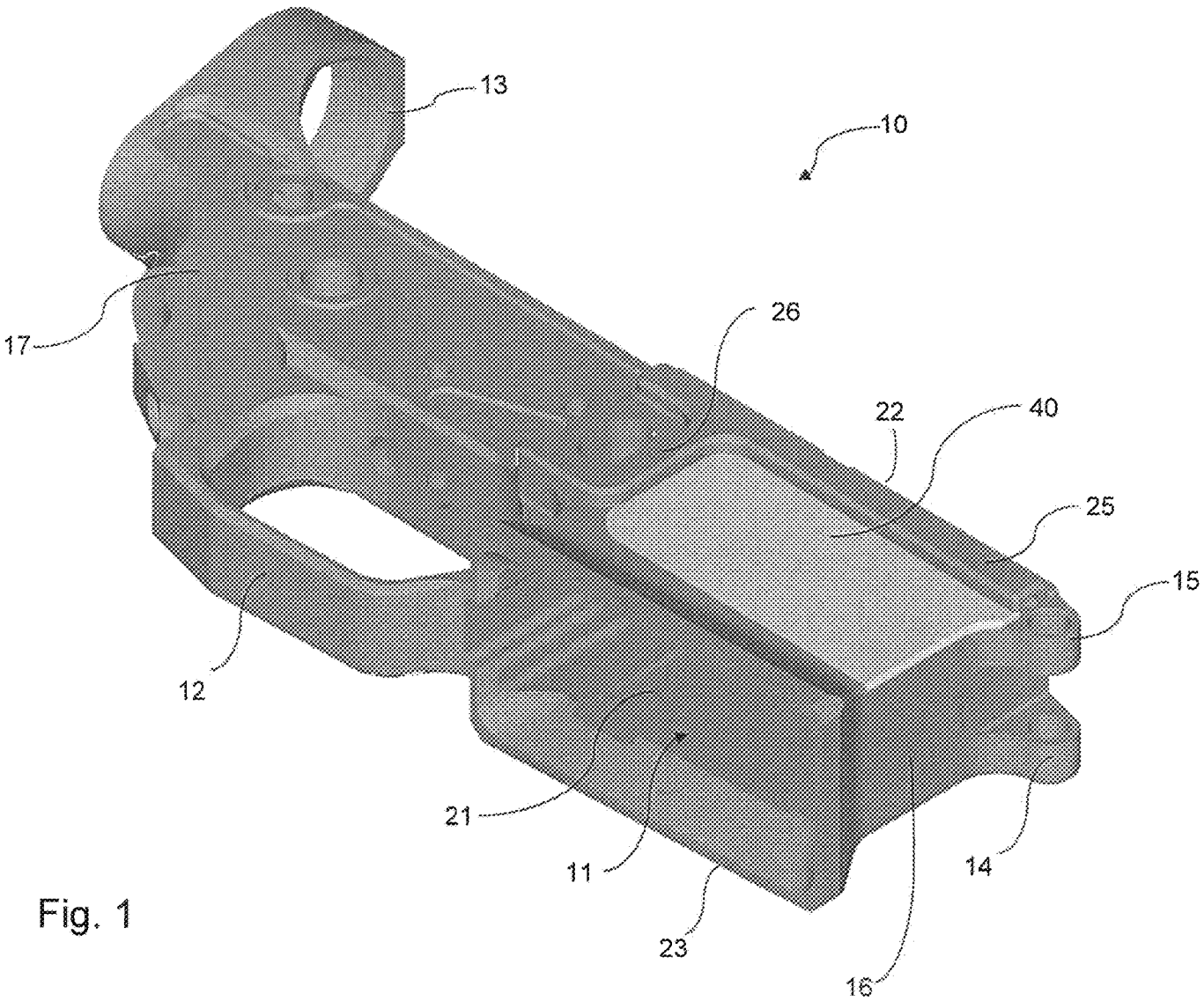
FIG. 1 is a lower perspective view of a firearm lower receiver having a removable insert.
Figure 2:
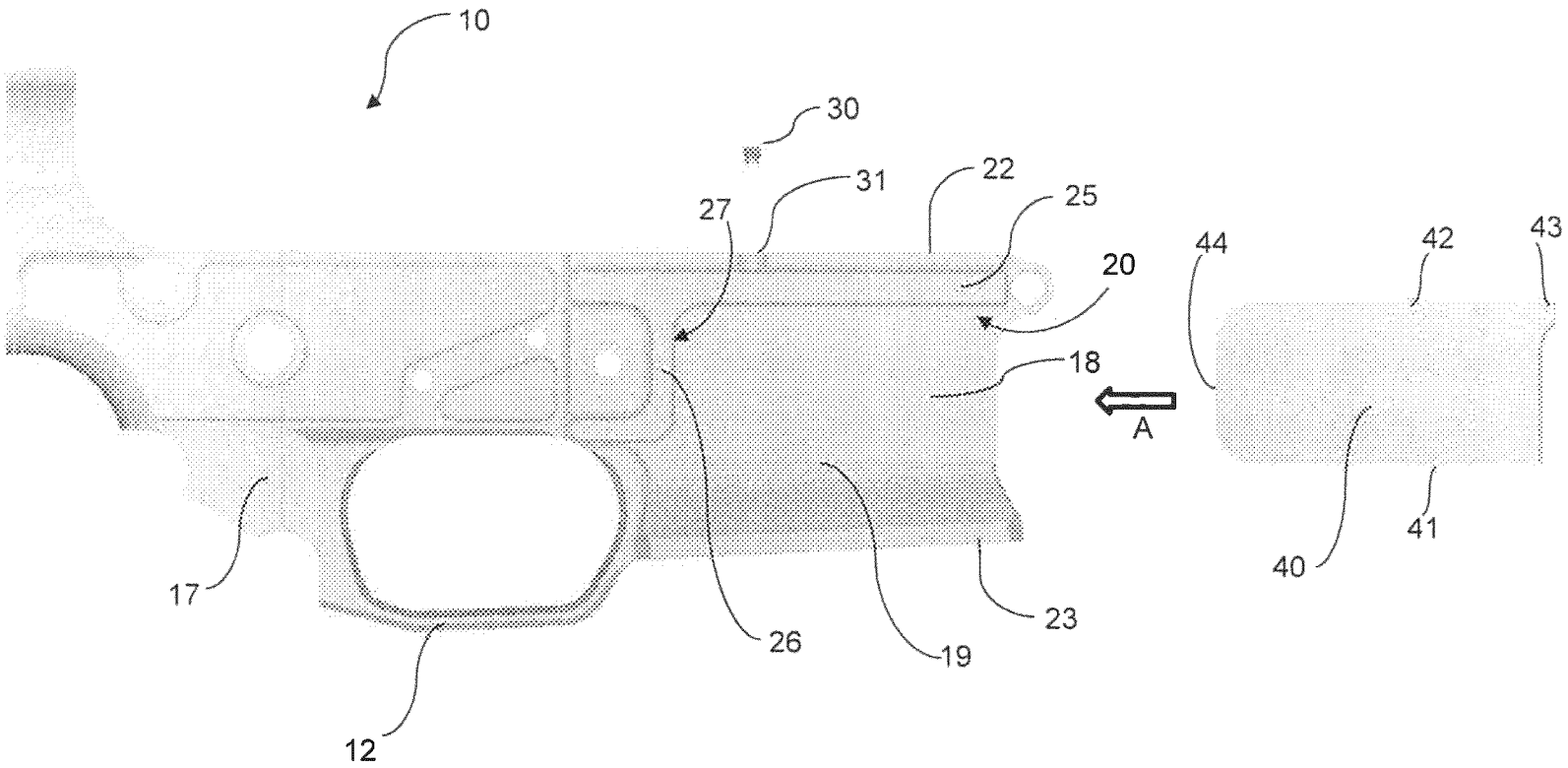
FIG. 2 is a front elevational exploded view of a firearm lower receiver having a removable insert.

A custom face 40 is configured for attachment to at least one of the outer surfaces of the opposing lateral sidewalls 18, 21 or the forward end wall 16. In FIG. 1, the custom face is shown as an insert plate mounted to the lower receiver 10. FIG. 2 is an exploded view showing the insert plate 40 separated, in which an arrow A indicates a direction in which the insert plate 40 may be moved to be attached to a first lateral sidewall 18 of the lower receiver 10. In the illustrated example, the custom face is sized to cover a majority of the first lateral sidewall 18 forming one side of the magazine well.

In the preferred example of FIGS. 1-5, the first lateral sidewall 18 of the lower receiver includes a lower ledge 19 and an upper groove or channel 20. The insert plate 40 includes an upper edge 42 and a lower edge 41, in which the lower edge 41 is configured to rest against and be supported by the lower ledge 19 of the lower receiver body 10. The upper edge 42 is configured to be received within the channel 20, and the preferred snug fit of the insert plate within the channel serves to retain the insert plate against the lower receiver. Likewise, the first lateral sidewall 18 is formed with a shallow cavity that matches the shape of the perimeter of the insert plate 40 (which in the preferred version is an open oblong shape, but in other versions may have a different shape). One end of the insert plate may include a projecting tab 43, which may aid in removal of the insert.

In one example, an upper end 22 of the lower receiver body 10 surrounding the magazine well may include a threaded bore 31 positioned above the channel 20. The bore is configured to receive a set screw 30, such that the set screw may be inserted into the bore and contact the upper edge 42 of the insert plate 40 to thereby force the lower edge 41 against the lower ledge 19 and hold the insert plate in position within the shallow cavity of the first lateral sidewall 18.

Figure 3:
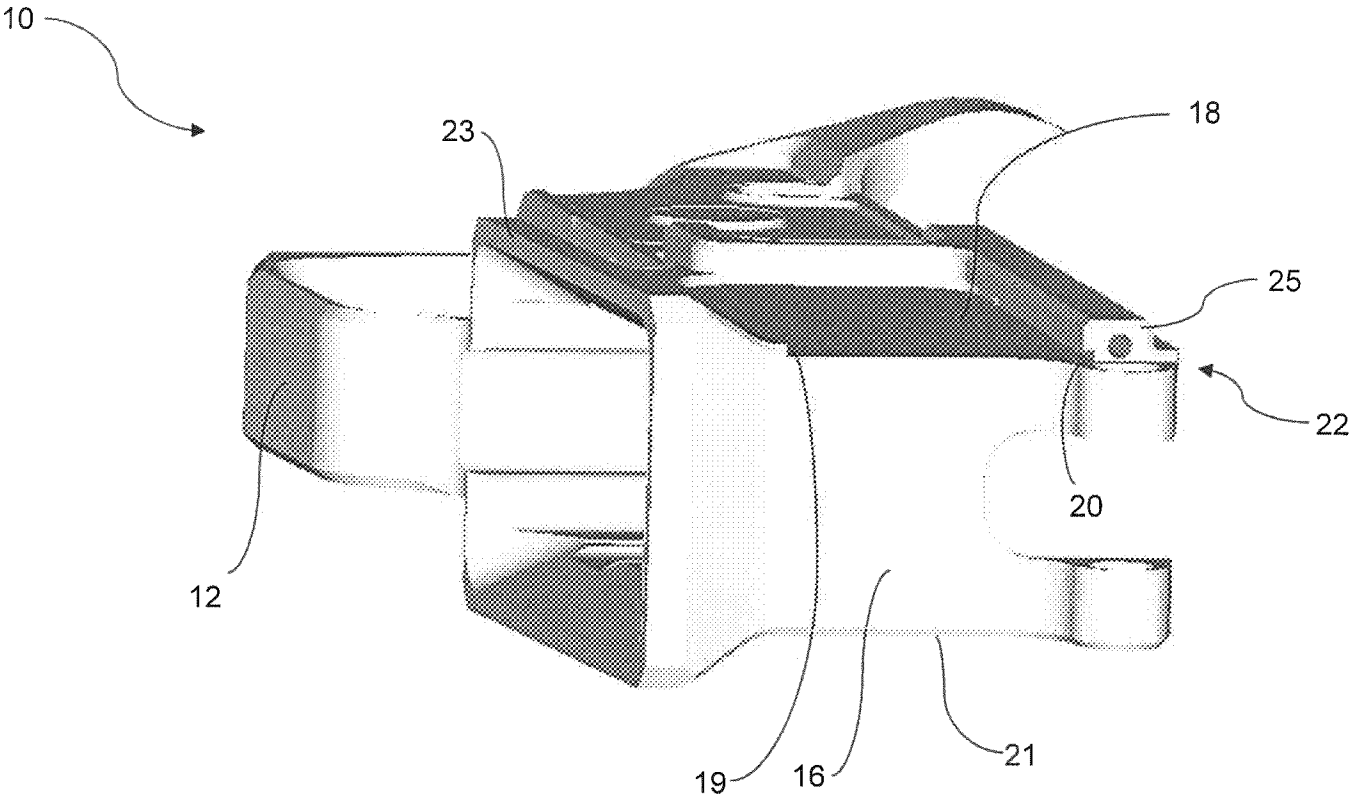
FIG. 3 is a side view of a firearm lower receiver having a removable insert, showing the forward end of the lower receiver and illustrating an upper slot and lower ledge.
Figure 4:
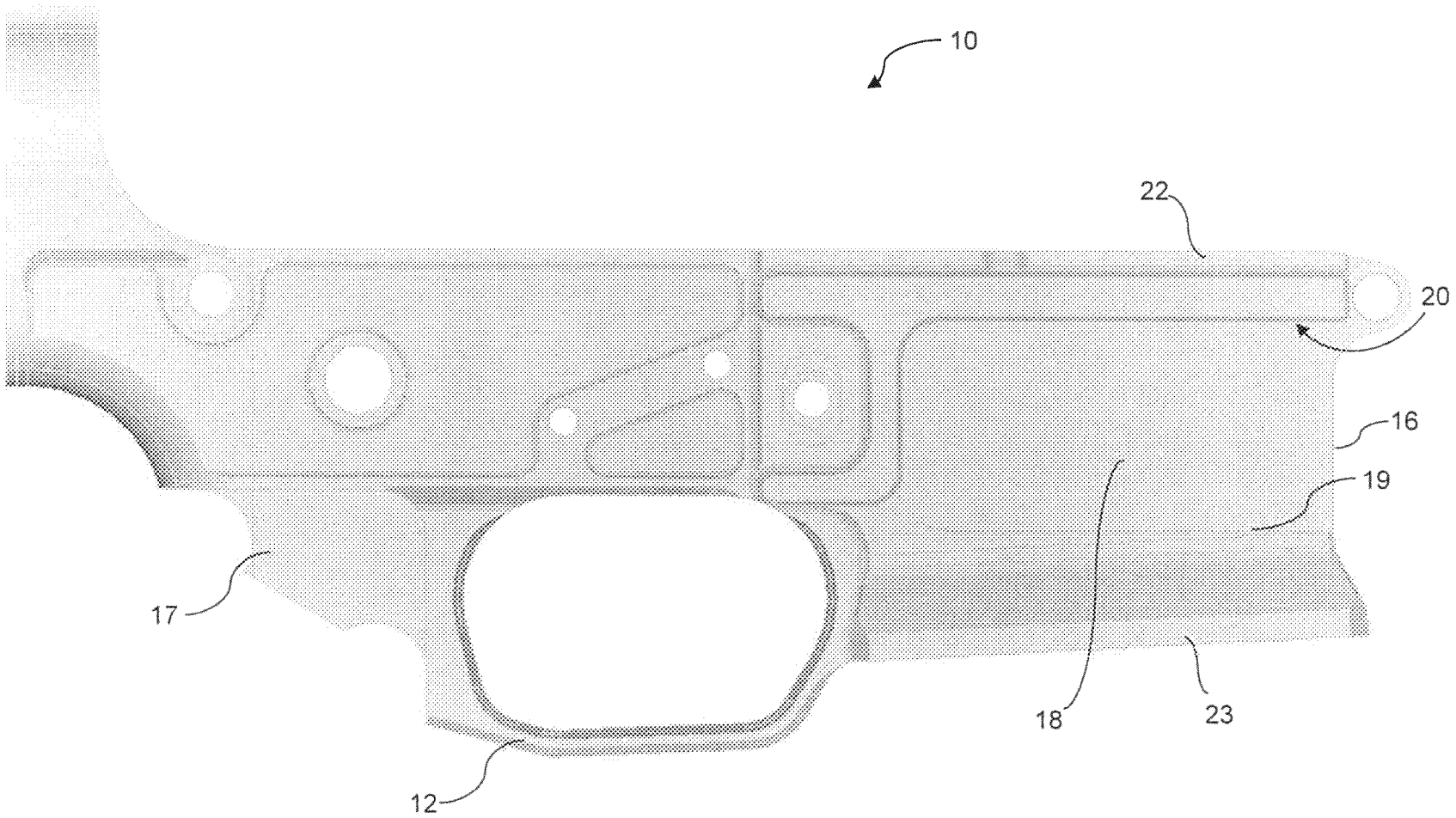
FIG. 4 is a front elevational exploded view of a firearm lower receiver configured to receive a removable insert.
Figure 5:
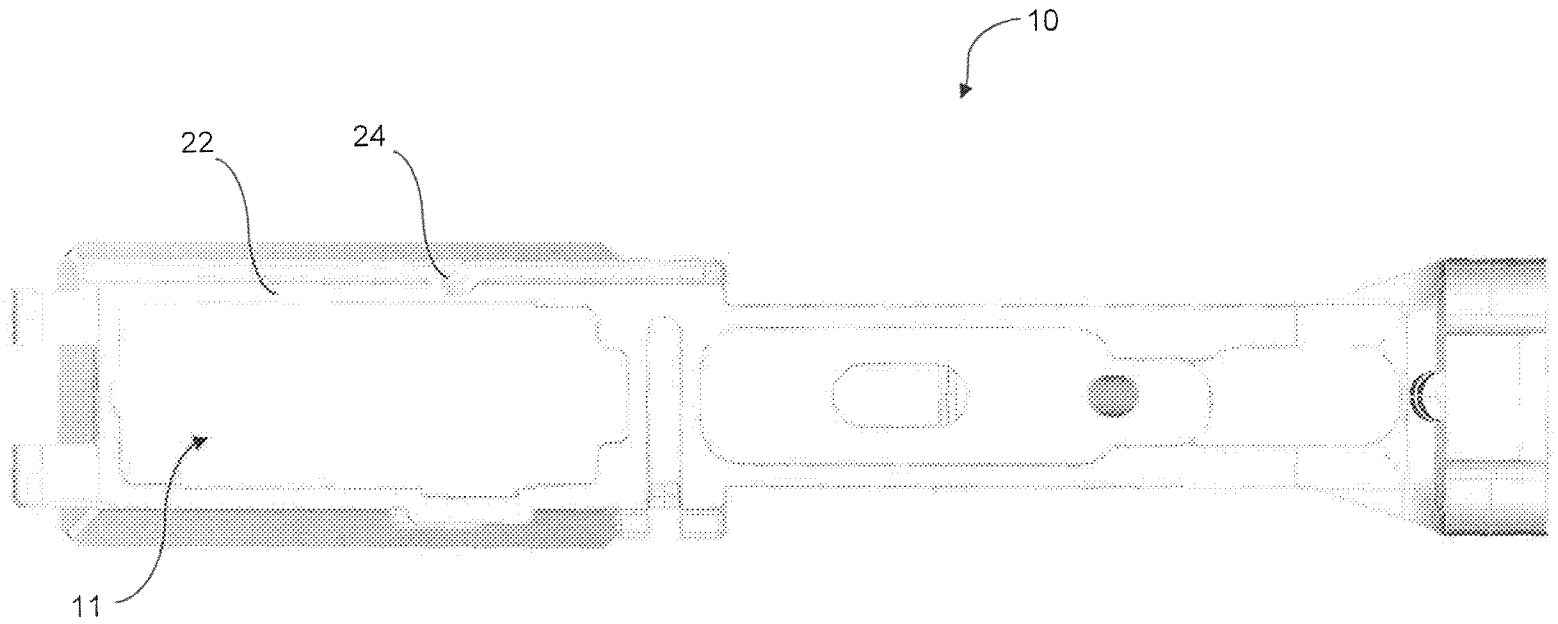
FIG. 5 is a top plan view of a firearm lower receiver configured to receive a removable insert.

In one version, the first lateral sidewall includes an upper bar 25 extending horizontally across the upper end 22 of the lower receiver. As illustrated, the upper bar is integrally formed with the lower receiver body. The channel 20 is positioned within the upper bar 25, as best seen in FIG. 3, so that the bar partially overhangs the shallow cavity formed on the first lateral sidewall 18. The upper bar 25 in one example may continue to a downward vertical rearward bar 26, in which the channel 20 also continues to form a rearward channel 27 within an internal portion of both the upper bar and the rearward bar. In such an example, the insert plate is retained by the channel along the upper edge 42 and the rearward edge 44.

The custom face 40 may be mounted differently in other versions of the invention. For example, as illustrated in FIG. 6 it may be attached using one or more fasteners 32, 33 such as screws extending through the custom face 40 and into receiving internally threaded bores (not shown) formed in the lower receiver. Yet other fasteners besides the set screw or face-mounted screws as illustrated may be use in other versions of the invention, including by magnetizing the custom face or incorporating a magnetic surface onto the custom face, or by snap-fit or friction-fit surfaces.

The custom face may optionally be configured with a design or logo 50 (see FIG. 6), or may be formed in different colors as may be desired. In yet other versions, the custom face may have a three-dimensional quality, with a custom design extending outwardly from the custom face 40. While the custom face is illustrated as a planar plate in the preferred example of the invention, in other versions the custom face need not be planar so long as it is configured for attachment to the lower receiver.

In yet another example, the custom face may be removably attachable to the front face of the forward end 16 of the lower receiver body, between the two lateral side faces 18, 21. In such a version, the custom face may be attached using fasteners in a manner such as described above. Optionally, custom faces may be attached to both opposing lateral faces and to the forward end.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

We claim:

1. A customizable firearm lower receiver, comprising:

a lower receiver body having a forward end and a rearward end, the forward end having a first lateral sidewall and an opposing second lateral sidewall at least partially surrounding a magazine well formed in the lower receiver body, the first lateral sidewall being positioned between an upper end and a lower end of the lower receiver; and a custom face removably attachable to the first lateral sidewall of the lower receiver body, the custom face further being sized to cover a majority of the first lateral sidewall when the custom face is attached to the first lateral sidewall.

2. The customizable firearm lower receiver of claim 1, wherein the first lateral sidewall comprises a cavity configured to receive and edge of the custom face, and further wherein the custom face is mounted within the cavity when the custom face is attached to the lower receiver body.

3. The customizable firearm lower receiver of claim 1, wherein the lower receiver body is configured to receive a fastener, the fastener engaging the custom face to retain the custom face against the first lateral sidewall of the lower receiver body when the custom face is attached to the lower receiver body.

4. The customizable firearm lower receiver of claim 1, wherein the lower receiver body further comprises an upper channel formed along an upper end of the first lateral sidewall of the lower receiver body, the custom face having an upper edge configured to be received within the upper channel.

5. The customizable firearm lower receiver of claim 4, wherein the custom face is formed as a plate.

6. The customizable firearm lower receiver of claim 5, wherein the lower receiver body further comprises an upper bar, the upper channel being formed within the upper bar, and further wherein the lower receiver body comprises a rearward bar, the upper channel continuing to form a rearward channel formed in the rearward bar, the custom face having a rearward edge configured to be received within the rearward channel.

7. The customizable firearm lower receiver of claim 6, further comprising a threaded bore positioned in the upper bar and a fastener receivable within the threaded bore, the fastener engaging the custom face to retain the custom face within the upper channel when the custom face is attached to the lower receiver body.

8. A customizable firearm lower receiver arranged to attach a removable custom face, the lower receiver, comprising:

a lower receiver body having a forward end and a rearward end, the forward end having a planar first lateral sidewall and an opposing second lateral sidewall, with a forward end wall between the first lateral sidewall and the second lateral sidewall;

the forward end wall, first lateral sidewall, and second lateral sidewall at least partially surrounding a magazine well formed in the lower receiver body;

a mounting surface configured on the lower receiver body along the first lateral sidewall; and a means for removably attaching the removable custom face to the first lateral sidewall, the custom face further being sized to cover a majority of the first lateral sidewall when the custom face is attached to the first lateral sidewall.

9. The customizable firearm lower receiver of claim 8, wherein the first lateral sidewall comprises a cavity configured to receive the custom face, and further wherein the custom face is mounted within the cavity when the custom face is attached to the lower receiver body.

10. The customizable firearm lower receiver of claim 8, wherein the means for removably attaching comprises a bore formed in the lower receiver body and a screw configured to be received within the bore.

11. The customizable firearm lower receiver of claim 8, wherein the lower receiver body further comprises an upper channel formed along an upper end of the lower receiver body, the custom face having an upper edge configured to be received within the upper channel.

12. The customizable firearm lower receiver of claim 11, wherein the lower receiver body further comprises an upper bar, the upper channel being formed within the upper bar, and further wherein the lower receiver body comprises a rearward bar, the upper channel continuing to form a rearward channel formed in the rearward bar, the custom face having a rearward edge configured to be received within the rearward channel.

13. The customizable firearm lower receiver of claim 12, further comprising a threaded bore positioned in the upper bar and a fastener receivable within the threaded bore, the fastener engaging the custom face to retain the custom face within the upper channel when the custom face is attached to the lower receiver body.

14. A customizable firearm lower receiver, comprising:

a lower receiver body having a forward end and a rearward end, the forward end having a magazine well defined by a first lateral sidewall and an opposing second lateral sidewall, with a forward end wall between the first lateral sidewall and the second lateral sidewall, the first lateral sidewall further having a lower ledge at a lower end of the first lateral sidewall;

a mounting surface configured on the first lateral sidewall; and a custom face removably attachable to the first lateral sidewall, the custom face abutting the lower ledge and retained by the mounting surface, and further covering the first lateral sidewall, when the custom face is attached to the first lateral sidewall.

15. The customizable firearm lower receiver of claim 14, wherein the mounting surface is formed as a cavity, and further wherein the custom face is formed as a plate and is mounted within the cavity when the custom face is attached to the lower receiver body.

16. The customizable firearm lower receiver of claim 14, wherein the lower receiver body is configured to receive a fastener, the fastener engaging the custom face to retain the custom face against the lower receiver body when the custom face is attached to the lower receiver body.

17. The customizable firearm lower receiver of claim 14, wherein the lower receiver body further comprises a channel, the custom face having an edge configured to be received within the channel.

18. The customizable firearm lower receiver of claim 17, wherein the custom face is formed as a plate, and further wherein the mounting surface is planar.

19. The customizable firearm lower receiver of claim 18, wherein the lower receiver body is configured to receive a fastener, the fastener extending into the channel and engaging the custom face to retain the custom face against the lower receiver body when the custom face is attached to the lower receiver body.

20. The customizable firearm lower receiver of claim 19, wherein the mounting surface is formed on the first lateral sidewall.

* * * * *